US005414973A

United States Patent [19]

Müller

[11] Patent Number: 5,414,973

[45] Date of Patent: May 16, 1995

[54] APPARATUS FOR CONVEYING A TEXTILE PRODUCT

[75] Inventor: Werner Müller, Heiningen, Germany

[73] Assignee: August Krempel Sohne GmbH & Co., Germany

[21] Appl. No.: 30,181

[22] PCT Filed: Jul. 15, 1992

[86] PCT No.: PCT/DE92/00579

§ 371 Date: Mar. 12, 1993

§ 102(e) Date: Mar. 12, 1993

[87] PCT Pub. No.: WO93/01980

PCT Pub. Date: Feb. 4, 1993

[30] Foreign Application Priority Data

Jul. 16, 1991 [DE] Germany ..... 41 23 446.4

[51] Int. Cl.[6] ..... B65B 35/24; B65B 25/20; B65G 15/14; B65G 21/14

[52] U.S. Cl. ..... 53/259; 53/260; 53/529

[58] Field of Search ..... 53/259, 260, 258, 255, 53/530, 529, 439; 100/151

[56] References Cited

U.S. PATENT DOCUMENTS

| | | | |
|---|---|---|---|
| 2,693,304 | 11/1954 | Davis et al. | 53/259 X |
| 3,932,982 | 1/1976 | Klapp | 53/259 X |
| 4,464,880 | 8/1984 | Peters et al. | 53/259 X |
| 4,592,193 | 6/1986 | Gustavsson | 53/530 |
| 5,022,216 | 6/1991 | Muckenfuhs et al. | 53/259 X |
| 5,123,231 | 6/1992 | Fallas et al. | 53/260 X |

FOREIGN PATENT DOCUMENTS

| | | | |
|---|---|---|---|
| 2516583 | 4/1975 | Germany | B65B 35/24 |
| 2604729 | 2/1976 | Germany | B65B 9/14 |
| 2940600 | 10/1979 | Germany | B65B 25/14 |
| 7018175 | 12/1970 | Netherlands | B65B 35/24 |

*Primary Examiner*—James F. Coan
*Attorney, Agent, or Firm*—Harness, Dickey & Pierce

[57] ABSTRACT

An apparatus for conveying a textile product from an upstream to a downstream station, especially for delivery into a package, has an endless conveyor belt driven by a drive and a pressure unit, the textile product being conveyed while held in a gripped manner between conveyor belt and pressure unit. To achieve rapid conveyance of the textile product without thereby impairing it, it is proposed that the conveyor belt be configured as a first telescoping belt, the front end of which, facing the downstream station, can move back and forth in the direction of the downstream station while the pressure unit follows this motion synchronously; and that the drive be controlled so that the belt of the telescoping belt is not driven as the front end moves back from the downstream station, and thereby rolls off the textile product.

10 Claims, 4 Drawing Sheets

APPARATUS FOR CONVEYING A TEXTILE PRODUCT

The invention concerns an apparatus for conveying a textile product from an upstream station to a downstream station, especially for delivery into a package, with an endless conveyor belt driven by a drive and with a pressure unit, the textile product being conveyed while held in a gripped manner between conveyor belt and pressure unit.

An apparatus of this kind has been operated by the applicant since 1989, under the designation BM 871.

In this known apparatus, a textile product, usually multiply folded or laid together, is conveyed from an upstream station in the form of a folding or laying apparatus to a downstream station, specifically a packing apparatus, and therein conveyed into a packaging pouch.

The textile product lies on a guide plate that is narrower than the width of the product being packaged, and also on two conveyor belts arranged at the same level immediately on either side of the guide plate. A pressure unit in the form of a pressure plate rests on the textile product so that the latter is held and guided while resting on the guide plate and the belts and while being held in a gripped manner by the pressure plate.

Moreover, the guide plate and the pressure plate can be moved relative to the stationary conveyor belts so that in the context of a linear advance motion the textile product is held in a gripped manner between guide plate and pressure plate, and can be inserted into a packaging pouch in the downstream station, configured as a packing unit. In the downstream station, it is then necessary for the textile product to come into contact with a retainer which immobilizes the textile product while the guide plate and pressure plate are pulled back, sliding along the retained textile product. Thus a relative motion occurs between the conveyed product and the conveying apparatus as it pulls back. To prevent damage to the product during this relative motion, the surfaces of the guide plate and pressure plate resting against the product must be very smooth. Furthermore, the pressure must not be so great that individual parts of the textile product are subjected to significantly higher friction than other parts during pullback. These differing friction values would then cause displacement of individual parts of the product during withdrawal, so that the latter is packed either unattractively or perhaps improperly. Such regions with differing friction values can be caused, for example, by seams, edges, sleeves, button rows, or simply by different materials on the textile product. For example, if the guide plate is pulled back over an end region of a shirt, a difference in friction value occurs between the sleeve of the shirt arm and the rest of the shirt product. This can then cause wrinkling and compression folds.

With synthetic materials, relative motion has the considerable disadvantage that electrostatic charging can occur, causing repulsive forces during the subsequent sealing process so that a reliable seal cannot be obtained.

A further disadvantage when the cycling rate is high is that the textile product arriving from the upstream station is delivered between the guide plate and pressure plate at relatively high speed, and is slowed therein to various degrees depending on the weight of the textile product, i.e. as a function of its inertia and surface finish, and therefore may possibly come to a stop at different points.

In the apparatus of the aforesaid type, insertion into the packaging pouch occurs in a manner such that the textile product, held in a gripped manner between the guide plate and pressure plate, is slid into the pouch. In this process, the leading end of the textile product must be brought to the rear, closed end of the packaging pouch. It must therefore be ensured that this leading end of the textile product comes to rest exactly at the level of the ends of the guide plate and pressure plate. As already mentioned, however, this is not always guaranteed. It has already been mentioned above that the pressure between guide plate and pressure plate must not be too great, since otherwise pressure imprints remain on the product, or displacements in the product can occur during withdrawal. The disadvantage of this is that when conveying occurs very quickly, i.e. when the guide plate and pressure plate are advanced very quickly, even when the textile product is placed correctly between these two elements, the product, because of its inertia, will be moved away from the front end if the pressure is low, so that when the product is then delivered into the pouch, its leading end cannot be transported down to the closed end of the pouch. A further disadvantage of the apparatus is that the product, clamped between the guide plate and the pressure plate, must be transported over a relatively long travel that is longer than the insertion depth of the pouch, since pouch opening devices which engage in the pouch and spread it apart are arranged immediately in front of the pouch.

The width of the stationary endless conveyor belts arranged next to the guide plate, taken together with the width of the guide plate, is greater than the width of the pouch or the inside width that is made available for insertion by the spreading device. The conveyor belts therefore end approximately one spreading-device length in front of the end of the pouch. The result is that with the maximum advance travel, the guide plate and pressure plate project a considerable distance beyond the front end of the conveyor belts, creating the danger that the two plates may deflect downward under the force of gravity.

The object of this invention is therefore to remedy this situation and to create an apparatus of the aforesaid type in which a textile product can be conveyed at high cycling rates and in proper position from an upstream to a downstream station, with no damage or displacement occurring to the material of the textile product.

The object is achieved, according to the invention, by the fact that the conveyor belt is configured as a first telescoping belt, the front end of which, facing the downstream station, can move back and forth in the direction of the downstream station; that the pressure unit follows this motion synchronously; and that the drive is controlled so that the belt of the telescoping belt is not driven as the front end moves back from the downstream station, and thereby rolls off the textile product.

A telescoping belt, on which the textile product lies and is moved, now serves as the only conveyor belt. Because the belt is configured as a telescoping belt whose front end, facing the downstream station, can move back and forth, the textile product is transported exclusively by a conveyor belt from the upstream to the downstream station, making it possible, by controlling the belt operation of the transport means itself, to bring the leading end of the textile product always to the exactly predefined position at the downstream station. Even if the textile product, when picked up from the upstream station, is laid down at a point that is "too far back," the belt operation drive of the conveyor belt must then operate for a correspondingly longer period until the leading end of the textile product comes to rest exactly at the level of the front edge or the front end of the telescoping belt. Irregularities in pickup from the upstream station can therefore be correspondingly compensated for. Because of the fact that the pressure unit synchronously follows the forward motion during conveyance, no relative displacement with respect to the telescoping belt and the pressure unit can occur as the telescoping belt advances. Furthermore, the entire width of the transport unit, which of course consists exclusively of the conveyor belt, can be reduced to a width that corresponds, (for example when the product is being delivered into a package) precisely to the inside width of the packaging pouch. This then makes it possible to design the telescoping belt so that at its farthest pulled-back position it ends directly in front of the deposit position, i.e. directly in front of the rear end of the deposited product. The advance motion of the telescoping belt is then limited to the length of the product or the length of a packaging pouch.

Because the belt drive stops when the telescoping belt moves back, the belt surface rolls off the product, meaning that no relative motion, in the manner of the aforesaid sliding motion, takes place between the product and transport means. Thus it is no longer necessary to provide retaining devices which immobilize the product so as to allow a withdrawal motion. This rolling-off motion is also entirely independent of the material of the textile product and of changes in material, for example different materials or the transition to a shirt arm or sleeve. The rolling-off process can occur very quickly with no alteration to the appearance of the textile product, even at high speeds. As a result, not only can the conveying cycling rate be substantially increased, but the risk of damage to the textile product is at the same time completely ruled out.

The object is completely attained in this manner.

In a further embodiment of the invention, the first telescoping belt has two stationary reversing rollers spaced apart from one another; furthermore a slide that can move back and forth is provided, which also has two reversing rollers spaced apart from one another, such that a front reversing roller of the slide represents the front end of the first telescoping belt, and a rear reversing roller of the slide lies in each case between the two stationary reversing rollers, such that the belt, arriving from a rear stationary reversing roller, is guided around the front movable reversing roller, then to the rear movable reversing roller, then to the front stationary reversing roller, and then back to the rear stationary reversing roller.

The advantage of this feature is that because of the slide, the telescoping back-and-forth motion of the front end of the telescoping belt can be performed very quickly and simply; the position of the rear roller of the slide, which is always located between the two stationary rollers, ensures that during the withdrawal motion while the belt drive is not operating, the force is exerted on the belt, ensuring that the latter rolls correctly off the product being deposited. Because this force can be exerted by the rear roller of the slide, the front roller can then be made correspondingly small, so that it can be inserted into a packaging pouch without requiring a great deal of room.

In a further embodiment of the invention, the drive can be controlled in such a way that as the front end moves toward the downstream station, the belt can also be moved toward the downstream station.

The considerable advantage of this feature is that with a superimposed motion, namely an advance motion of the front end simultaneously with motion of the belt in the same direction, the product can be conveyed very quickly from the upstream to the downstream station, which substantially increases cycling rates.

In a further embodiment of the invention, a common drive for both motions is provided.

The advantage of this feature is that it results in an apparatus with simple design features, which also helps to lessen the weight of the moving parts.

In a further embodiment of the invention, the pressure unit is configured as a second telescoping belt, whose end facing the downstream station, and whose belt, can move synchronously with the first telescoping belt.

This feature then has the considerable advantage that the textile product is moved forward not merely by the action of the belt on which it is lying, but simultaneously by the synchronously moving belt of the telescoping belt of the pressure unit. Engagement of the advancing belts on both flat sides of the textile product allows for extremely uniform transfer of force onto the textile product, allowing for extremely high transport speeds.

In a further embodiment of the invention, the second telescoping belt is constructed identically to the first telescoping belt and is arranged as a mirror image thereof.

The advantage of this feature is that the mirrored arrangement and identical configuration allow the implementation of structurally simple features with parts that vary little in design, and also make possible a simple synchronous control system using a single drive.

In a further embodiment of the invention, a chassis that supports the stationary reversing rollers of the telescoping belts is provided; furthermore a slide that supports the further reversing rollers is provided; and a drive that synchronously controls the two telescoping belts is provided.

The advantage of this feature is that with the central slide, the advance motion of the synchronous belts and their movable front ends can be implemented very easily with mechanically simple means, which can result in high advance speeds.

In a further embodiment of the invention, the front reversing roller constituting the front end of the respective telescoping belt is configured with the smallest possible diameter, and furthermore is attached at the front end of a guide plate whose thickness corresponds approximately to the diameter of the front reversing roller.

The advantage of this feature is that the belt slides over the guide plate on both sides and is guided at the front end by the reversing roller, so that a continuous smooth guide surface for the textile product can be created. The narrow or small-diameter configuration of the front reversing roller then requires only a small additional space between the textile product and the inside of a packaging pouch. Experiments have determined that this additional space requirement corresponds approximately to the extent to which a textile product can be compressed while being conveyed without being impaired, and the extent to which it then expands again. Thus after it expands or puffs up, the conveyed textile product is then located in the exact preselected position in the packaging pouch, with the desired thickness.

In a further embodiment of the invention, when the front reversing roller is in its most fully pulled-back position, the guide plate extends between the said roller and the rear stationary roller.

The advantage of this feature is that when the textile product is picked up from the upstream station, at which the telescoping belt is in the retracted position—i.e. the front reversing roller is in its most fully pulled-back position—a continuous stable guide surface is created by the guide plate. When the front end of the telescoping belt extends, the textile product is then immediately moved out so that at any future point in time it is lying on a region of the belt in which the latter contacts the guide plate. This then also guarantees, at any point in time during transport, the appropriate spacing between conveyor belt and pressure unit, so that the textile product is guided during the entire conveying period with a uniform spacing away from the pressure unit.

In a further embodiment of the invention, the guide plate is provided, directly next to the longitudinal edges of the belt, with edge rails that extend above the level of the guide plate by at least the thickness of the belt.

The advantage of this feature is that the edge rails simultaneously constitute spacing rails for insertion into a packaging pouch, i.e. the edge rails keep the inside of the packaging pouch far enough away from the belt (which is still moving forward as it is inserted) that no contact can occur between it and the packaging pouch.

This considerably improves the operating reliability of the apparatus, even at fast operating speeds.

In a further embodiment of the invention, the pressure unit is configured as a pressure plate that is attached to the slide in a manner adjustable as to height.

The advantage of this feature is that textile products which have a very smooth and uniform surface, for example bed linens that have been folded several times, in which no protrusions resulting from decoration or borders are present and in which there are also no changes in material or weave direction, can be quickly and reliably guided by only one telescoping belt along the pressure plate. In this case, when the telescoping belt moves backward, a relative motion occurs between the pressure plate and textile product, but this is confined to one side and therefore can be used, for example, for heavy products such as the aforesaid bed linens or large tablecloths.

It is understood that the features mentioned above and those yet to be explained below can be used not only in the aforesaid combination, but also in other combinations or in isolation, without leaving the context of the present invention.

The invention will be explained and described in more detail below with reference to several selected exemplary embodiments, in conjunction with the drawings.

Figure 1:
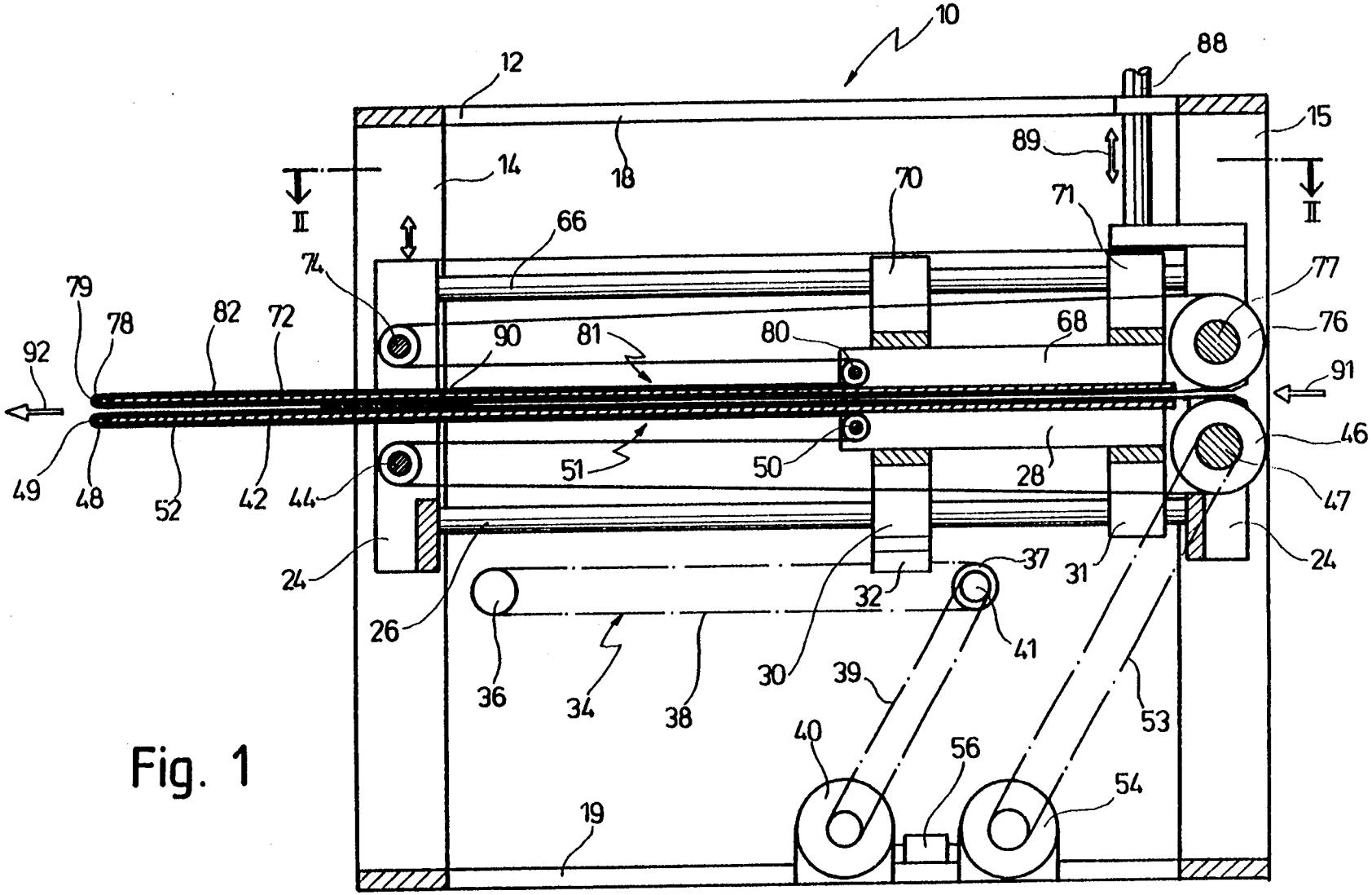
FIG. 1 shows a highly schematic vertical section of a first exemplary embodiment of an apparatus according to the invention.
Figure 2:
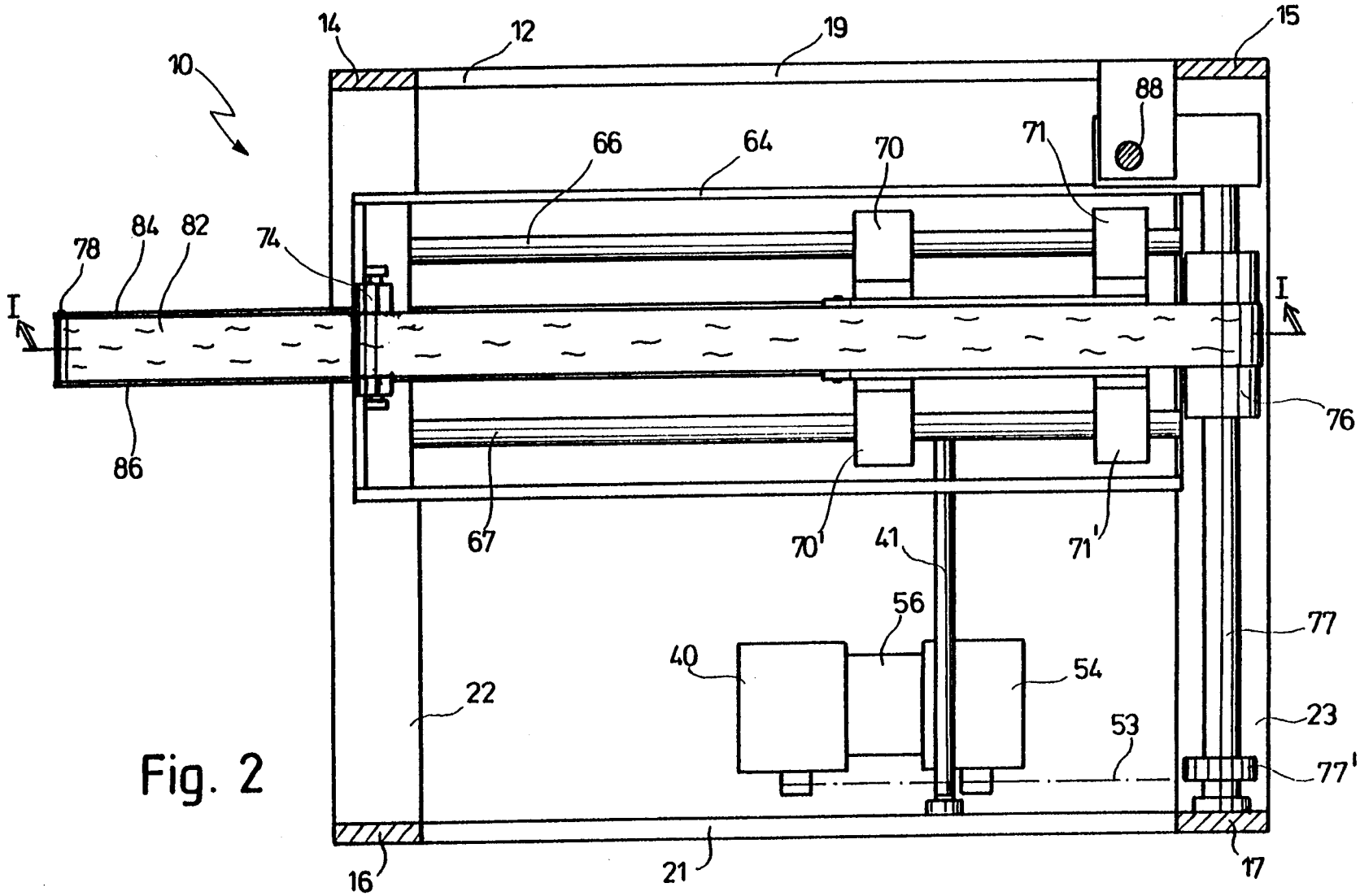
FIG. 2 shows a horizontal section along line II—II of FIG. 1.
Figure 3A:
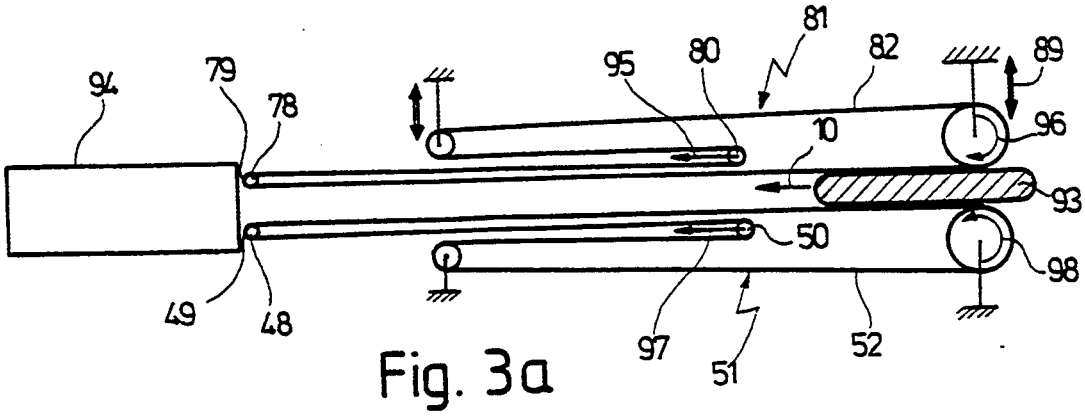
Figure 3B:
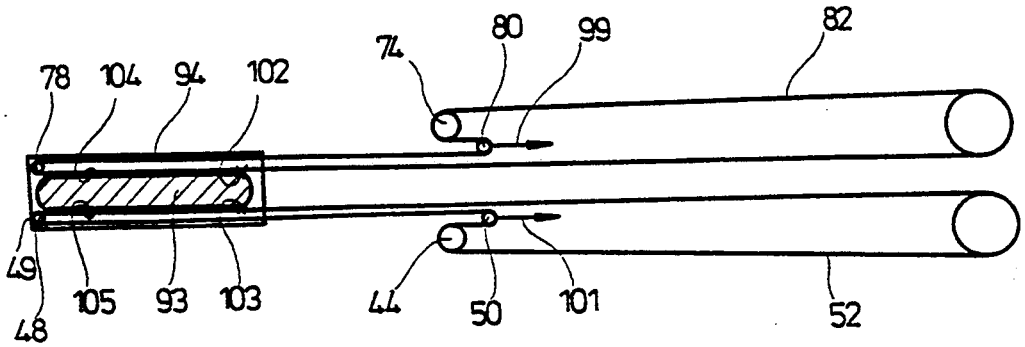
Figure 3C:
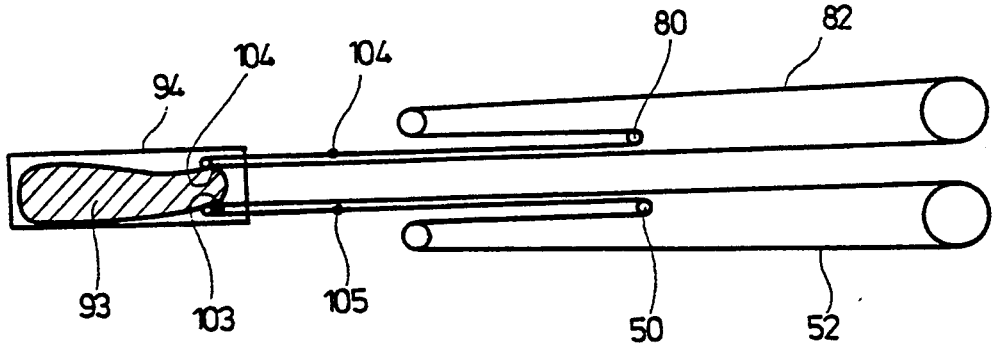
Figure 4A:
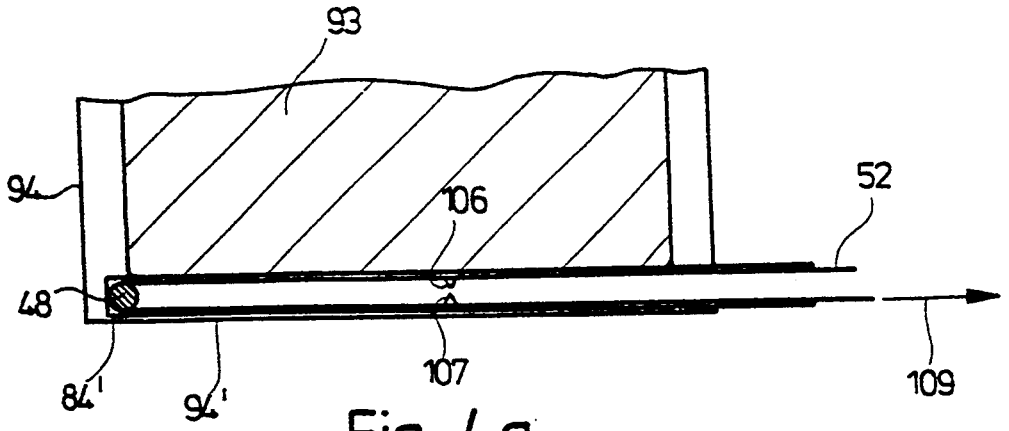
Figure 4B:
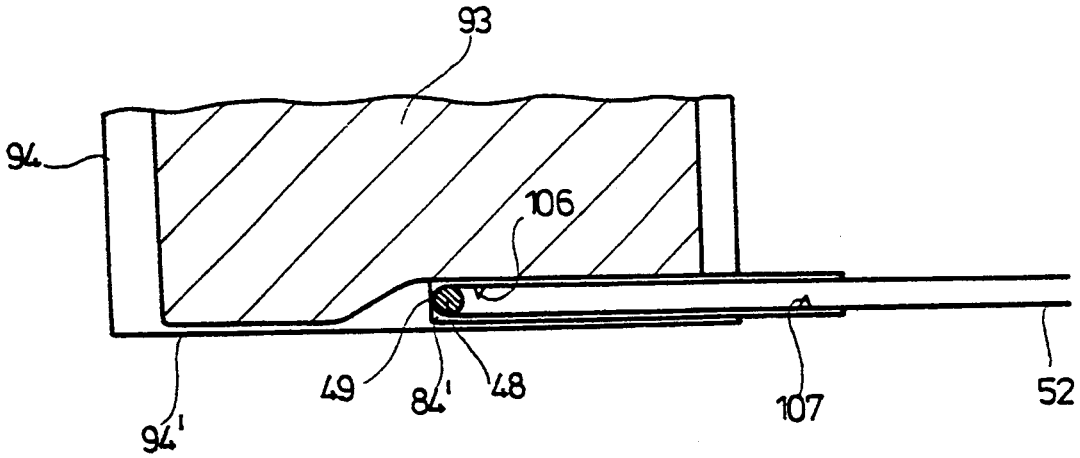
Figure 5:
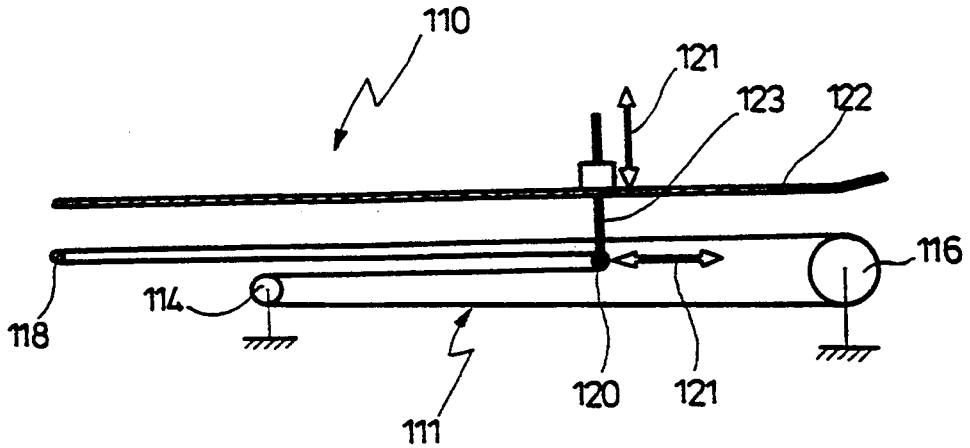

FIGS. 3*a* to 3*c* show, in highly schematic fashion, the operation of the apparatus depicted in FIGS. 1 and 2;

FIGS. 4*a* and 4*b* show, at greatly enlarged scale, a detail of the apparatus depicted in FIGS. 1 to 3 in the vicinity of the front end as a product is being deposited at a downstream station; and FIG. 5 shows a further exemplary embodiment of an apparatus according to the invention.

An apparatus depicted in FIGS. 1 and 2 is given the reference number 10 in its entirety.

The apparatus 10 has a chassis 12 that is constructed from four vertical supports 14, 15, 16, and 17 that stand at the corners of a rectangle.

The vertical supports 14 are connected by means of corresponding longitudinal supports 18, 19, and 21 or by transverse supports 22, 23 to produce a cage-like chassis.

The chassis 12 supports a first stationary frame 24 that extends over the entire length of the chassis 12 and has two longitudinal guide rods 26. In the depiction of FIG. 1, only one of the two guide rods 26 (which are located at the same height) is visible.

The guide rods 26 support a slide 28, on the underside of which two slide bushings 30, 31 are provided, through which the guide rod 26 runs. The guide rod parallel to the guide rod 26 then runs through two corresponding slide bushings.

The slide bushing 30 is provided at its lower end with an extension 32 that is in non-positive engagement with a linear drive 34.

The linear drive 34 consists of two rollers 36, 37 around which runs a drive chain 38, which is in the aforesaid non-positive engagement with the extension 32.

The roller 37 is connected to a shaft 41 (see especially FIG. 2), which in turn is connected by means of a belt 39 to a motor 40.

The slide 28 can be moved back and forth along the guide rods 26 by the linear drive 34.

The slide 28 is also provided at its upper end with a guide plate 42 whose front end extends beyond the chassis 12 on one side (to the left in the depiction of FIG. 1).

The frame 24 supports a first reversing roller 44 at the level of the front vertical support 14.

At the level of the vertical support 15, the frame 24 has a rear reversing roller 46 of greater diameter.

The two reversing rollers 44, 46 are thus permanently mounted in the chassis.

The rear reversing roller 46 sits on a shaft 47 (see especially FIG. 2) that is connected by means of a belt 53 to a drive 54, the drive 54 being connected to the drive 40 via a common control system 56.

Arranged at the front end of the guide plate 42 is a front reversing roller 48 whose diameter corresponds approximately to the thickness of the guide plate 42.

A rear reversing roller 50 is also arranged on the slide 28.

The front reversing roller 48 and the rear reversing roller 50 can be moved back and forth with the slide 28 along the guide rod 26, but maintain a constant distance between each other. An endless belt 52 is guided around the reversing rollers 44, 46, 48, 50, resulting in a first telescoping belt 51.

The belt 52 is guided in such a way that when viewed from an upper surface line (as depicted in FIG. 1) of the rear reversing roller 46, it is guided horizontally over the guide plate 42, i.e. it slides over it as far as the front reversing roller 48. The guide plate 42 extends, as is especially evident from FIG. 1, approximately from the rear reversing roller 46 to the front reversing roller 48.

Then the belt 52 is guided around the front reversing roller 48 and, in contact with the underside of the guide plate 42, is guided to the rear reversing roller 50 on the slide 28.

The upper surface line of the reversing roller 50 (as depicted in FIG. 1) is located approximately at the level of the underside of the guide plate 42.

The belt 52 runs around the rear reversing roller 50 and is guided to the left (as depicted in FIG. 1) or forward to the stationary front reversing roller 44 on the frame 24. This brings an upper surface line (as depicted in FIG. 1) of the front reversing roller to the level of a corresponding lower surface line of the rear reversing roller 50.

The belt 52 runs around the front stationary reversing roller 44 and is guided from there back to the rear stationary reversing roller 46 on the frame 24.

Arranged above the frame 24 is a further frame 64, which is designed identically to and as the mirror image of the frame 24, i.e. it has two guide rods 66, 67 (see FIG. 2), which support a slide 68.

The slide 68 is provided with slide bushings 70, 71 through which the guide rod 66 runs, and is further provided with slide bushings 70', 71' through which the guide rod 67 runs.

The slide 68 is provided at its lower end (as depicted in FIG. 1) with a guide plate 72, which is configured identically to the guide plate 42.

The frame 64 also has a stationary front reversing roller 74 as well as a stationary rear reversing roller 76.

A front reversing roller 78 is provided at the front end of the guide plate 72, and a rear reversing roller 80 is provided on the slide 68. A belt 82 is guided around the reversing rollers 74, 76, 78, and 80 so as to result in a second telescoping belt 81 that is arranged as the mirror image of the first telescoping belt 51. For this purpose, the belt is guided around the underside of the rear stationary reversing roller 76 and the underside of the guide plate 72 to the front reversing roller 78, is then guided to the rear reversing roller 80, then back to the front stationary reversing roller 74, and then from there back to the top of the rear stationary reversing roller 76.

As is evident especially from FIG. 1, the respective corresponding reversing rollers of the two telescoping belts 51 and 81 are arranged at the same height when viewed longitudinally.

The respective reversing rollers 46 and 76 of the two telescoping belts 51 and 81 driven by the shafts 47 and 77 are driven jointly and synchronously by the drive 54. For this purpose, a gear that is connected by means of a cardan shaft to a gear 77' on the shaft 77 sits on the shaft 47, thus causing the reversing rollers 46 and 76 (see FIG. 3*a*) to rotate in opposite directions.

The slides 28 and 68 are permanently connected to one another in such a way that when the slide 28 is moved back and forth by the linear drive 34, the slide 68 also moves synchronously with it.

However, the slide 68 is adjustable in height relative to the slide 28, for which purpose it is connected to a spindle 88, so that the slide 68 can be raised or lowered by rotating the spindle 88, as indicated by a double arrow in FIG. 1. The aforesaid cardan gear drive provides corresponding compensation while maintaining drive engagement.

The drawing depicts only one spindle 88, although four spindles, arranged at the corners of a rectangle, are provided for reasons of symmetry and stability.

The distance between the opposing running surfaces of the belts 52 and 82 can be adjusted by raising or lowering the slide 68; this distance depends on the height of the product 90 that is to be conveyed between the opposing running surfaces of the belts 52 and 82 by means of the apparatus 10 from an upstream station 91 to a downstream station 92.

The operation of the apparatus 10 depicted in FIGS. 1 and 2 will now be described further with reference to FIGS. 3*a* to 3*c*, in which the apparatus 10 is depicted in highly schematic fashion and the same reference numbers as in FIGS. 1 and 2 are used for identical components.

It is evident from FIG. 3*a* that the product 93 being conveyed has a greater height than the product 90 depicted in FIG. 1, so that the frame 54 together with the slide 68 has been raised to the point that the product 93 can be received between the opposing running surfaces of the belts 52 and 82. The distance is set so that the product 93 is received between the belts 52 and 82 without pressure or with only slight pressure.

The textile product 93 is to be delivered into a packaging pouch 94 in a downstream station. As is evident especially from FIG. 3*a*, the front ends 49 and 79 of the telescoping belts 51 and 81, respectively, are located directly in front of the insertion opening of the packaging pouch 94. Because of the fact that the front ends 49, 79 project beyond the chassis 12 of the apparatus 10 (see especially FIG. 2), corresponding spreading devices (not depicted here), which open the packaging pouch 94 and hold it open sufficiently so that, as described in FIG. 3*b*, the front ends 49, 79 can be extended into the packaging pouch 94, can be arranged between the chassis 12 and the packaging pouch 94.

The control system 56 for the drives 40, 54, and 34 (see FIG. 1) is such that during the period in which the front ends 49, 79 of the telescoping belts 51, 81 have moved in as far as the inner rear closed end of the pouch 94, the product 93 is moved from the position depicted in FIG. 3*a* to the position depicted in FIG. 3*b*. In other words, the belt drive for the belts 52, 82 (arrows 96, 98) operates more quickly than the linear drive for the corresponding slides (arrows 95 and 97).

Once the apparatus has reached the working position depicted in FIG. 3*b*, the drive for the belts 52 and 82 is halted and only the linear drive 34 moves the slides 28 and 68 back, as indicated in FIG. 3*b* by arrows 99 and 101. In this withdrawal motion, the belt surface of belts 52 and 82 in contact with the outside of the product 93 rolls off, with no relative displacement motion occurring between these belts and the product 93. If one considers the transition from FIG. 3*b* to FIG. 3*c*, and considers two contact points 102 and 103, each depicted by a cross, on the top and bottom of the product 93, and two further contact points 104 and 105 marked with a dot, it is evident from FIG. 3*c* that as the slides 28 and 68 and the reversing rollers 58 and 80 connected to them are pulled back from the position depicted in FIG. 3*b* to that of FIG. 3*c*, the relative position between points 102 and 103 has not changed.

The contact points 104 and 105 no longer exist, since the upper belt 82 has rolled off in such a way that in the meantime, the point 104 (after passage of the backward-moving reversing roller 78) has moved and has come to rest on the top of the guide plate 72; the same applies in mirror image for the point 105.

The product 93 can then expand appropriately and fill the packaging pouch 94 completely.

This roll-off situation is depicted again in FIGS. 4*a* and 4*b* at further enlarged scale, with the lower belt 52 being depicted here.

It is evident from FIG. 4*a* that two opposite points 106, 107 on the inside of the belt move when the belt 52 is pulled back so that the point 106 remains in position until the reversing roller 48, moving backwards, approaches the point 106, which then, as the reversing roller 48 is pulled back further, is guided around it and thereby withdrawn by the rear reversing roller 50.

It is clear from this that during withdrawal, no relative motion occurs between the belt surface[s] on which the product 93 is lying.

It is further evident from FIGS. 4*a* and 4*b* that the edge rails 84' have a height such that, in the depiction of FIGS. 4*a* and 4*b*, a bottom portion 94' of the packaging pouch 94 is spaced away from the running surface of the belt 52, so that no contact with the material of the pouch can take place as the telescoping belts 51, 52 are inserted or withdrawn.

FIG. 5 depicts a further exemplary embodiment of an apparatus according to the invention, which is provided with the overall reference number 110.

The apparatus 110 is identical in principle to the apparatus depicted in FIGS. 1 and 2, except only that the upper second telescoping belt 81 is not present, and instead only a pressure plate 122 is provided.

Hence the apparatus 110 has a first telescoping belt 111 that corresponds in its configuration and spatial arrangement to the first telescoping belt 51. Hence two stationary reversing rollers 114 and 116, as well as two movable reversing rollers 118, 120 are also provided here.

The slide (not depicted here) belonging to the telescoping belt 111 supports a pressure plate 122, whose height can be adjusted by means of a spindle 123, which runs parallel to the upper running surface of the belt of the telescoping belt 111. When the slide is moved back and forth as described above, as depicted in FIG. 5 by a double arrow 121, the pressure plate 122 is therefore synchronously moved along with it.

For withdrawal of the telescoping belt 111, a control system can be provided that raises the pressure plate 122 a few millimeters (see arrow 121) before the telescoping belt 111 is withdrawn, so that there is no sliding motion between the product and pressure plate during withdrawal; instead the product is again, as depicted in FIG. 4*b*, simply deposited as the belt rolls off.

I claim:

1. Apparatus for conveying a textile Product from an upstream station to a downstream station, in particular for delivering a textile product into a package, said apparatus comprising:

drive means driving a first telescoping belt means comprising a first belt part of which extends in a first direction between a downstream station and an upstream station., said first telescoping belt means further comprising a first front end facing said downstream station, said first belt being guided around said first front end which is arranged for movement back and forth either backwards towards said upstream station or forwards towards said downstream station;

second telescoping belt means comprising a second belt part of which extends in said first direction parallel to said part of said first belt, said second telescoping belt means further comprising a second front end facing said downstream station, said second belt being guided around said second front end which is arranged for movement back and forth;

wherein said first and second belts are arranged at such a distance from each other that a textile product may be conveyed between both belts while being enclosed between both belts;

said first and said second front ends are arranged for synchronous motion back and forth in said first direction; and said drive means is controlled such that said first and second belts are not driven when said first and second front ends are moved simultaneously backwards in said first direction, thereby releasing said textile product.

2. Apparatus according to claim 1, which further comprises:

two stationary first reversing rollers spaced apart from one another comprising a first front stationary reversing roller and a first rear stationary reversing roller;

a first slide adapted for moving back and forth in said first direction, said first slide having a first front reversing roller and a first rear reversing roller;

wherein said first front reversing roller of said first slide comprises said first front end;

said first rear reversing roller of said first slide is arranged between said two first stationary reversing rollers; and said first belt is guided around said first rear stationary reversing roller to said first front reversing roller, around said first front reversing roller to said first rear reversing roller, around said first rear reversing roller to said first front stationary reversing roller and back to said first rear stationary reversing roller.

3. Apparatus according to claim 1, wherein said drive means is controlled such that as said first front end moves forwards in said first direction also said first belt moves forwards in said first direction.

4. Apparatus according to claim 2, which further comprises:

two stationary second reversing rollers spaced apart from one another comprising a second front stationary reversing roller and a second rear stationary reversing roller;

a second slide adapted for moving back and forth in said first direction, said second slide having a second front reversing roller and a second rear reversing roller;

wherein said second front reversing roller of said slide comprises said second front end;

said second rear reversing roller of said slide is arranged between said two second stationary reversing rollers;

said second belt is guided around said second rear stationary reversing roller to said second front reversing roller, around said second front reversing roller to said second rear reversing roller, around said second rear reversing roller to said second front stationary reversing roller and back to said second rear stationary reversing roller;

said first telescoping belt means and said second telescoping belt means are constructed identically and are arranged mirror symmetrically to one another.

5. Apparatus according to claim 1, which further includes an adjusting means for adjusting the distance between said first and said second belts.

6. Apparatus according to claim 4, which further includes a chassis supporting the first and second stationary reversing rollers, and wherein said first and said second belts are both driven by said drive means.

7. Apparatus according to claim 2, wherein said first slide further includes a first guide plate extending along said first direction, said first guide plate holding said first front reversing roller at one end thereof, said first front reversing roller having a diameter which approximately corresponds to the thickness of said guide plate.

8. Apparatus according to claim 4, wherein said second slide further includes a second guide plate extending along said first direction, said guide plate holding said second front reversing roller at one end thereof, said second front reversing roller having a diameter which approximately corresponds to the thickness of said guide plate.

9. Apparatus according to claim 8, wherein said first and second guide plates comprise rear ends being adjacent said first and second rear stationary reversing rollers when said guide plates are in their rearmost positions.

10. Apparatus according to claim 8, wherein each of said guide plates is provided with edge rails, said edge rails extending along said first direction for guiding said first or second belt therebetween.

* * * * *